United States Patent [19]

Holpp

[11] Patent Number: 4,638,267

[45] Date of Patent: Jan. 20, 1987

[54] MILLIMETER WAVE CIRCULATOR

[75] Inventor: Wolfgang Holpp, Illertissen, Fed. Rep. of Germany

[73] Assignee: Licentia Patent-Verwaltungs-GmbH, Fed. Rep. of Germany

[21] Appl. No.: 717,708

[22] Filed: Mar. 29, 1985

[30] Foreign Application Priority Data

Mar. 29, 1984 [DE] Fed. Rep. of Germany ..... 3411621

[51] Int. Cl.[4] ..... H01P 1/39

[52] U.S. Cl. ..... 333/1.1; 333/227

[58] Field of Search ..... 333/1.1, 24.1, 24.2, 333/208, 209, 227, 231

[56] References Cited

U.S. PATENT DOCUMENTS

| | | | |
|---|---|---|---|
| 3,422,375 | 1/1969 | Omori | 333/1.1 |
| 3,466,571 | 9/1969 | Jansen et al. | 333/1.1 |
| 3,714,608 | 1/1973 | Barnes et al. | 333/1.1 |

FOREIGN PATENT DOCUMENTS

| | | | |
|---|---|---|---|
| 2161977 | 6/1973 | Fed. Rep. of Germany | 333/1.1 |

*Primary Examiner*—Paul Gensler

*Attorney, Agent, or Firm*—McGlew and Tuttle

[57] ABSTRACT

In a Y circulator, the ferrite body is so dimensioned that at the operating frequency, not the dominant mode, but two higher order modes are excited having their frequencies close to each other.

5 Claims, 6 Drawing Figures

MILLIMETER WAVE CIRCULATOR

FIELD AND BACKGROUND OF THE INVENTION

This invention relates in general to high frequency devices and in particular to a new and useful millimeter-wave circulator.

Millimeter wave circulators are usually designed as Y circulators and employed as nonreciprocal junctions, for example for decoupling transmitters from receivers, or a synchronizing millimeter wave source from a power amplifier.

The bandwidths of such circulators are typically about from 1 to 2%. Because of these bandwidths and since the resonant frequency of ferrite resonators primarily depends on the geometrical dimensions thereof, high requirements are to be imposed on the mechanical tolerances in the ferrite manufacture and mounting, if, for example, a minimum isolation is to be maintained at a given operating frequency. To enlarge the bandwidth, it is known to reduce the Q factor of the circulator arrangement which, however, always involves undesirably increased transmission losses.

SUMMARY OF THE INVENTION

The invention is directed to a millimeter wave circulator having a substantially larger bandwidth in comparison with the prior art.

In accordance with the invention, a millimeter-wave circulator comprises an H-plane waveguide junction with a static magnetic field oriented perpendicularly to the junction. A circularly cylindrical ferrite body is located at the center of the waveguide junction and exposed to the static magnetic field. In accordance with the invention, the dimensions determining the resonant frequency of the ferrite body are so selected that the operating frequency of the circulator falls within the range of two neighboring close spaced resonant frequencies of higher order than that of the dominant mode of the ferrite body.

The resonant frequency of a circularly cylindrical body of a certain ferrimagnetic material in the circulator arrangement is a quantity which, while disregarding the effect produced by the ambience, depends on the excited mode and the geometry of the ferrite body. A given ferrite body thus has a plurality of resonant frequencies, corresponding to the various modes (resonances). On the other hand, if a desired resonant frequency in a definite mode is predetermined, the geometry of the ferrite body is fixed, as far as the dimensions determining the frequency, i.e. the diameter and/or height of the ferrite cylinder, are concerned. The theoretical relations between the individual determining factors have been described many times and, for purposes of the present invention, are considered known.

In accordance with the invention, the ferrite body in the circulator arrangement is excited by a wave oscillating at the operating frequency of the millimeter system in the neighboring modes (resonances) which are higher than the dominant mode. What is substantial is that the resonant frequencies of the excited two modes are closely adjacent, preferably by a frequency spacing of less than 10% of the average value of the frequencies. With a proper broadband excitation, these modes are coexistent and the transmission characteristics corresponding to the individual modes combine to a new characteristic with a substantially larger operating bandwidth. The specification for fabrication then will advantageously be directed to obtain, with relatively small requirements on tolerances, a coincidence between the middle of the band and the predetermined operating frequency. Due to the substantially larger bandwidth, manufacturing tolerances are acceptable to a much larger extent.

Particularly advantageous is an embodiment in which the ferrite body is so dimensioned that the operating frequency within the range of the resonant frequencies of the ferrite body is obtained in the $TE_{011}$ and $TE_{211}$ modes. By resonant frequencies of the ferrite body, the resonant frequencies of a cavity resonator surrounding the ferrite body and having metallic walls is understood in this connection and in the following. (The subscripts correspond to the generally used designation of resonances in circularly cylindrical waveguides, see, for example: Taschenbuch der Hochfrequenztechnik (High Frequency Manual) by Meinke & Gundlach). With a required isolation of at least 20 dB, this arrangement has a relative bandwidth of about 8%. In addition, with this selection of modes, the important advantage is obtained that in both modes the resonance frequencies substantially depend only on the height of the ferrite body. Since this height is a distance between two planar parallel surfaces, its accuracy can be much better insured in manufacture, for example, by a lapping operation, than the accuracy of the diameter of a circular cylinder.

To make sure that the two modes will build up without disturbance, in an advantageous development of the invention, the waveguide junction is enlarged to a circularly cylindrical cavity resonator.

Accordingly, it is an object of the invention to provide an improved millimeter wave circulator which includes an H-plane waveguide junction with means defining a static magnetic field oriented perpendicularly to the junction and circularly cylindrical ferrite body at the center of the waveguide junction which is exposed to the static magnetic field wherein the dimensions of determining the resonant frequency of the ferrite body are so selected that the operating frequency of the circulator falls within the range of two neighboring close spaced resonant frequencies of higher order than that of the dominant mode of the ferrite body.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
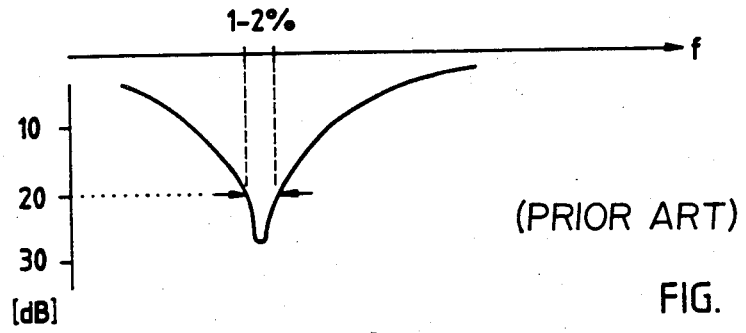
(PRIOR ART) FIG. 1
FIG. 1 is a curve showing the frequency response of the isolation in a prior art circulator.

With the required isolation of at least 20 dB, a conventional prior art circulator having an isolation frequency response as shown in FIG. 1, has a bandwidth of only 1 to 2%, for example, which means a bandwidth of only 1 to 2 GHz at an operating frequency of 100 GHz. Since the dimensions of ferrite bodies range within millimeters and less, meeting of corresponding manufacturing tolerances is hardly possible at reasonable costs, so that the exact frequency adjustment must be obtained by subsequent selection and by external adjusting circuits.

Figure 2:
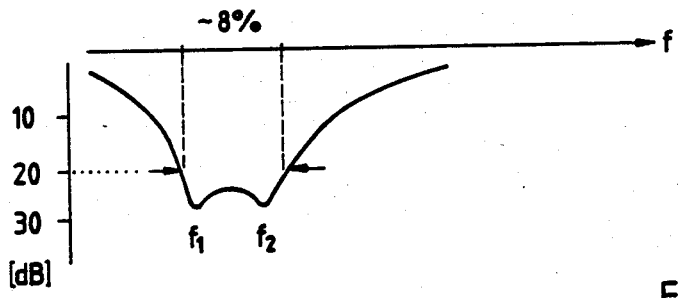
FIG. 2 is a similar showing for an inventive circulator.

With the inventive design of the circulator, on the contrary, a frequency response of the isolation is obtained as shown in FIG. 2. The two resonant frequencies $f_1$ and $f_2$ are so close together that even between the two maximums of attenuation, the isolation is everywhere better than the required 20 dB. With a relative operating bandwidth of about 8%, an inventive circulator is substantially less sensitive to tolerances in the manufacture and mounting of ferrite bodies, than a circulator of the prior art design, so that subsequent adjustments may be omitted or effected at lower costs.

Figure 3:
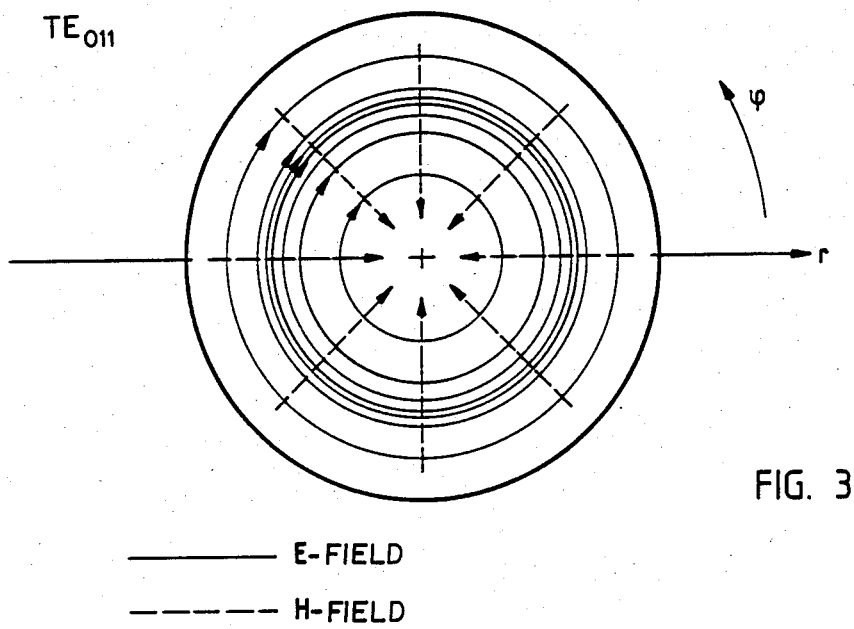
FIG. 3 is a plan view of the field configuration at the $TE_{011}$ resonance.
Figure 4:
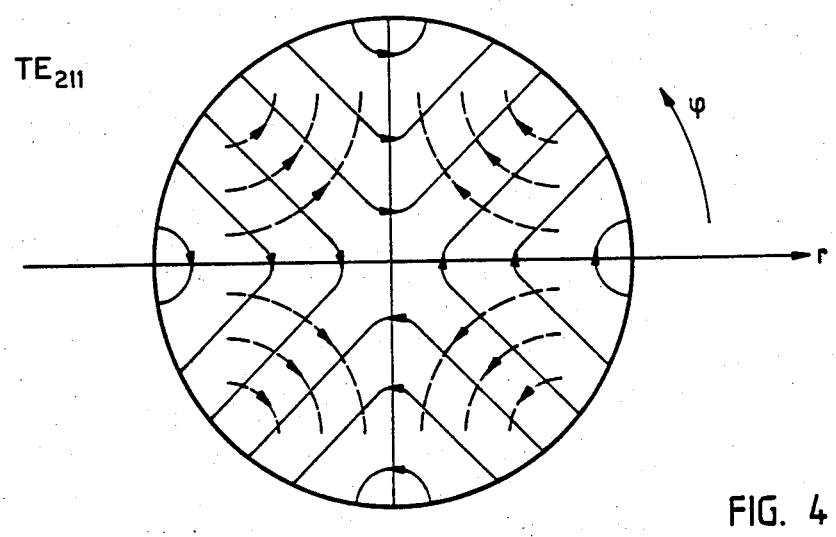
FIG. 4 is a similar view of the field configuration at the $TE_{211}$ resonance.

With the $TE_{011}$ resonance indicated in FIG. 3 as a field configuration in the ferrite body projected into the plane of a waveguide junction, the electric field has no component in the direction of the axis of the circularly cylindrical ferrite body. This is also true of the $TE_{211}$ resonance indicated in FIG. 4. The magnetic lines (broken lines) are spatial curves penetrating into the space behind the drawing plane.

Figure 5:
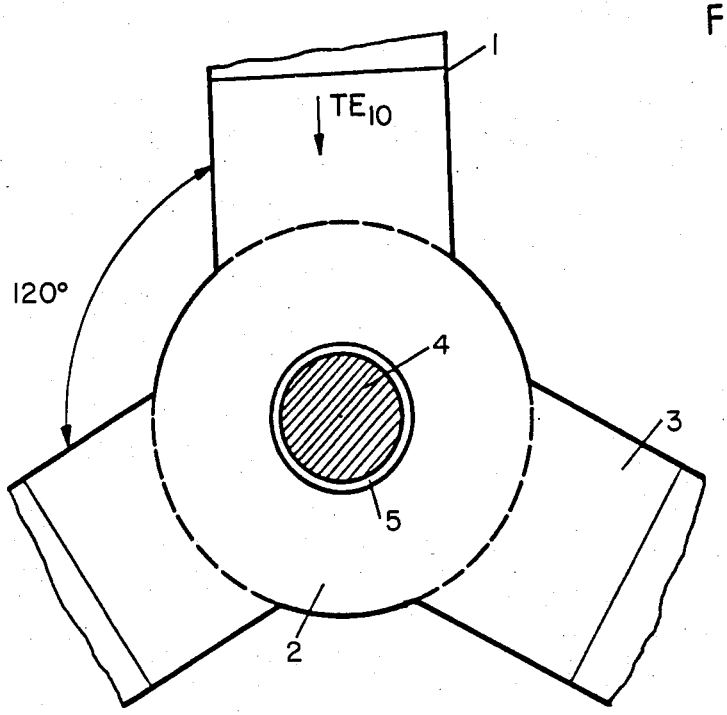
FIG. 5 is a partial horizontal sectional view and top plan view of a circulator.
Figure 6:
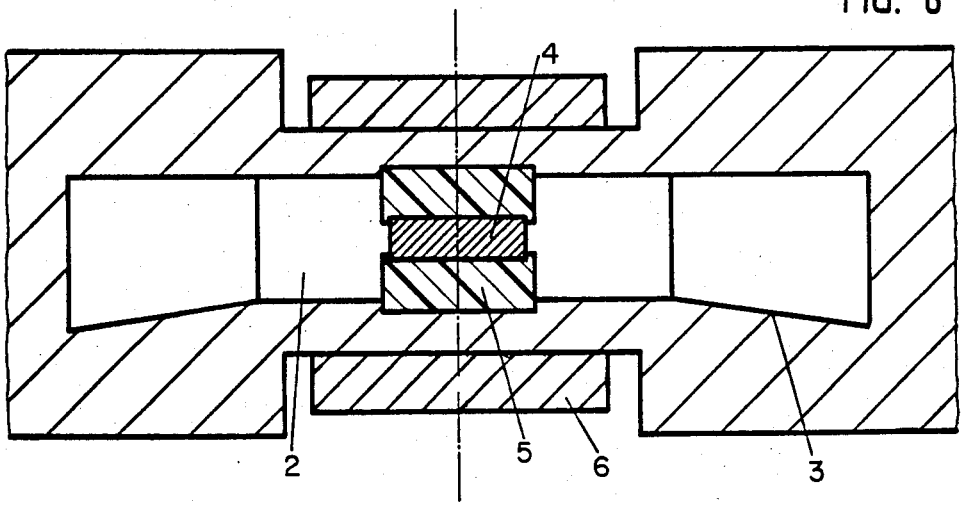
FIG. 6 is a partial vertical sectional view and side view of an embodiment of a circulator.

FIGS. 5 and 6 are sectional views of a circulator arrangement in which the modes $TE_{011}$ and $TE_{211}$ are excited. The excitation is effected in a manner well known in the art, namely through a waveguide connection arm 1 with a wave, for example in the rectangular waveguide mode $TE_{10}$. The Y waveguide junction is enlarged to a circularly cylindrical cavity resonator 2. The top or bottom wall of the resonator is provided with a linear taper 3 reducing the height of the waveguide to match the impedances. This height may also be reduced by providing a circumferential step. The circularly cylindrical ferrite body 4 is positioned at the center of the cavity resonator, and insulated against the bottoms by two discs of plastic 5. The ferrite body has also the shape of a disc. For an operating frequency of about 93 GHz, the height of the ferrite body is about 0.5 mm, and the diameter about 1.5 mm. The discs of plastic have a slightly larger diameter than the ferrite body and are shaped each with a circumferential shoulder within which the ferrite body is fixed. The discs of plastic in turn are fixed in recesses in the top and bottom of the cavity resonator. The ferrite body is thereby automatically centered in the resonator. The depth of the recesses is minimized to reduce the field distortions at the rim of the recesses. Two permanent magnets 6 produce the necessary constant magnetic field.

While a specific embodiment of the invention has been shown and described in detail to illustrate the application of the principles of the invention, it will be understood that the invention may be embodied otherwise without departing from such principles.

What is claimed is:

1. A millimeter wave circulator comprising an H-plane waveguide junction, means defining a static magnetic field in the vicinity of said junction, a circularly cylindrical ferrite body at the center of said waveguide junction exposed to said static magnetic field, said ferrite body being dimensioned so that the operating frequency of said circulator falls within the range of two neighboring closely spaced resonant frequencies of higher order than that of the dominant mode of said ferrite body, said two neighboring closely spaced resonant frequencies being of $TE_{011}$ and $TE_{211}$ modes.

2. A millimeter wave circulator according to claim 1, wherein said waveguide junction is enlarged to a circularly cylindrical cavity resonator.

3. A millimeter wave circulator according to claim 1, wherein for impedance matching, the height of the waveguide is reduced in said junction area of three arms of the waveguide.

4. A millimeter wave circulator according to claim 1, wherein said ferrite body is positioned symmetrically between the top and bottom walls of said waveguide and is insulated against both of these walls.

5. A millimeter wave circulator according to claim 4, including two dielectric spacers insulating said ferrite body against said waveguide walls.

* * * * *